US005207793A

United States Patent [19]

Brand et al.

[11] Patent Number: 5,207,793

[45] Date of Patent: May 4, 1993

[54] HAMMERING GAME

[75] Inventors: Derek A. Brand, Camarillo; Derek R. Brand, Carpinperia; Kenneth J. Brand, Camarillo, all of Calif.; Takeshi Sano, Yono Saitama, Japan

[73] Assignee: Tyco Investment Corp., Wilmington, Del.

[21] Appl. No.: 832,247

[22] Filed: Feb. 7, 1992

[51] Int. Cl.[5] ..... A63F 9/00

[52] U.S. Cl. ..... 273/445; 273/440

[58] Field of Search ..... 273/440, 445; 446/415

[56] References Cited

U.S. PATENT DOCUMENTS

| | | | |
|---|---|---|---|
| 947,043 | 1/1910 | Mason . | |
| 2,540,061 | 3/1949 | Szantay . | |
| 3,608,903 | 9/1971 | Cooper et al. . | |
| 3,841,629 | 10/1974 | Barlow . | |
| 4,234,181 | 11/1980 | Breslow et al. | 273/440 |
| 4,244,568 | 1/1981 | Ferris et al. | 273/445 |
| 4,319,751 | 3/1982 | Kurushima et al. . | |
| 4,334,680 | 6/1982 | Liversidge . | |
| 4,524,967 | 6/1985 | Hanson et al. | 273/440 |
| 4,573,944 | 3/1986 | Crow et al. . | |

*Primary Examiner*—V. Millin
*Assistant Examiner*—Raleigh W. Chiu
*Attorney, Agent, or Firm*—Panitch, Schwarze, Jacobs & Nadel

[57] ABSTRACT

A hammering game apparatus has a pair of mechanically articulated hammer devices coupled with a base mounting a motor-driven revolving platform. The platform has a plurality of pegs protruding through it. One or more players attempt to hammer down the pegs into the base with the hammer device(s). The pegs are driven from a raised position to a lower position on the platform with two longer pegs engaging a stop beneath the platform when driven sufficiently down into the platform. The platform is spring-supported and is pressed down towards the base to raise the pegs back to the raised position.

23 Claims, 5 Drawing Sheets

HAMMERING GAME

FIELD OF THE INVENTION

The present invention relates to a game apparatus and, more particularly, a hammering game where players attempt to strike and drive pegs into a platform.

BACKGROUND OF THE INVENTION

In the toy field, there exists a need for a hammering game apparatus which is amusing and entertaining. Further, present-day game players prefer games which require challenging hand-eye coordination. Moreover, the game must be safe for children to play.

Various hammer-motif game and toy devices have been disclosed in the prior art. For example, U.S. Pat. No. 2,540,061 discloses a hammer toy which includes a base, a cover overlying the base, the cover having a plurality of holes, a spring urging apart the cover and the base, pegs extending through each hole in the cover, the pegs being frictionally held in place in the holes. The pegs can be individually hammered and moved downward through the holes. The pegs can be repositioned for further hammering by collapsing the cover towards the base against the action of the spring which causes the pegs to move outwardly. To accomplish this, a head can be struck with a sharp blow with the hammer to compress the spring-biased cover toward the base. The pegs are frictionally held within the holes in the cover by a resilient band such as a rubber band which encircles the pegs underneath the cover.

U.S. Pat. No. 3,608,903 discloses a toy game apparatus which comprises a game box enclosing inflated balloons. The game box is opaque with an open bottom wherein the top of the box provides a playing surface having precut nail-receiving perforations. Perforations are Y-shaped and are constructed to enable the offering of some resistance to driving the nails through them. The game additionally comprises nails and a conventional hand-held hammer.

U.S. Pat. No. 3,841,629 discloses a game apparatus where players strike plungers on a base which, through linkages, cause pivotal movement of numbered flaps also on the base. The plungers are struck with a hand-held striking member which has an elongated handle portion and an enlarged striking portion. The striking member may be shaped in the form of a tomahawk, with the game apparatus stimulating a drum.

U.S. Pat. No. 4,319,751 (the '751 patent) discloses a game apparatus including a base with two stationary figures, each figure including a pivotally mounted shield and hammerhead. The shield and hammerhead of each figure are linked together with a common spring return and are simultaneously moved by depressing a button on the base linked to the shield and hammer. Each player moves their respective hammerhead in an attempt to strike the head of their opponent's playing member. A successful blow to the opponent results in the release of the head from the body of the opposite playing member.

SUMMARY OF THE INVENTION

Briefly stated, in one aspect, the present invention comprises a game apparatus. The game apparatus comprises a base having at least one mechanically articulated hammer device coupled to it. A platform is mounted to revolve on the base and a plurality of pegs protrude through the platform. The pegs are positioned to be hammered into the platform by the hammer device.

In another aspect, the present invention comprises a base which has one or more mechanically articulated hammer devices coupled to it. A motor-driven revolving platform located above the base has a plurality of protruding pegs positioned to be hammered down into the form by any of the hammer devices.

BRIEF DESCRIPTION OF THE DRAWINGS

The foregoing summary, as well as the following detailed description, is better understood when read in conjunction with the appended drawings. For the purpose of illustrating the invention, an embodiment which is presently preferred is shown in the drawings. It is understood, however, that this invention is not limited to the precise arrangements and instrumentality shown. In the drawings.

DESCRIPTION OF THE PREFERRED EMBODIMENT

Figure 1:
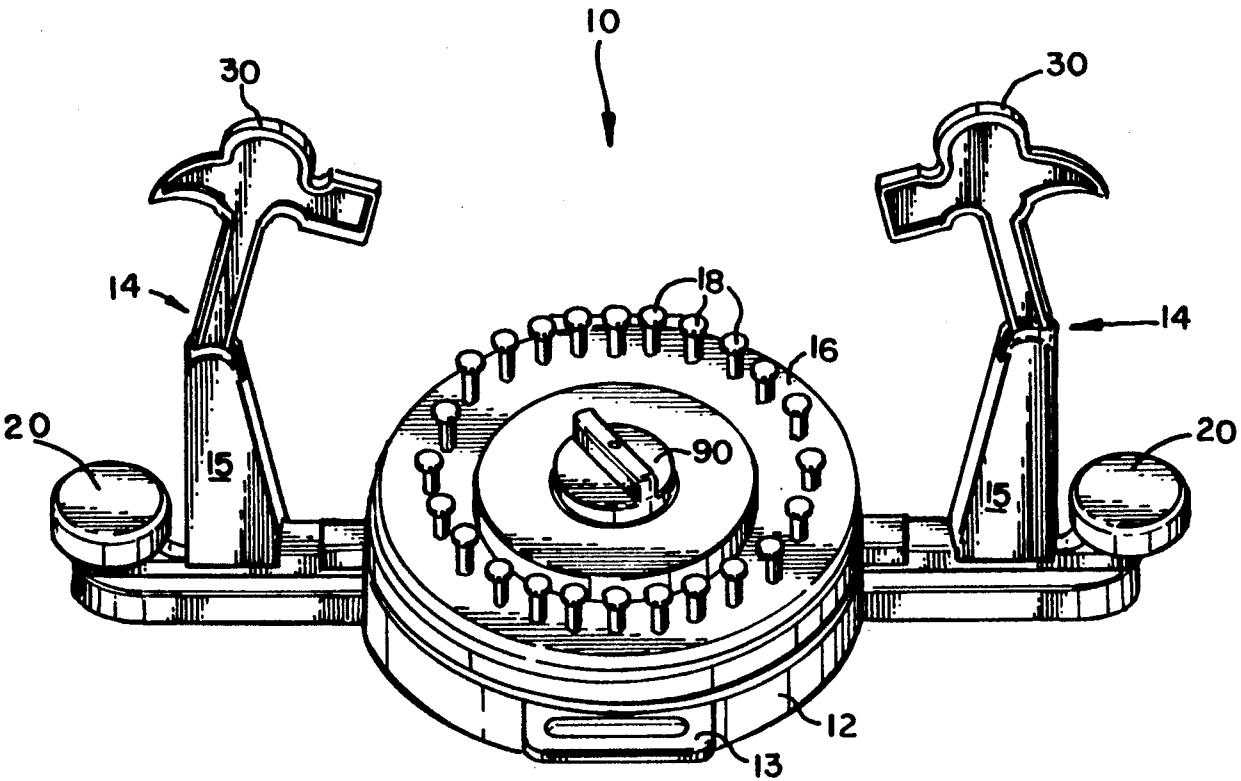
FIG. 1 is a perspective view of an exterior configuration of a game apparatus in accordance with the present invention.
Figure 2:
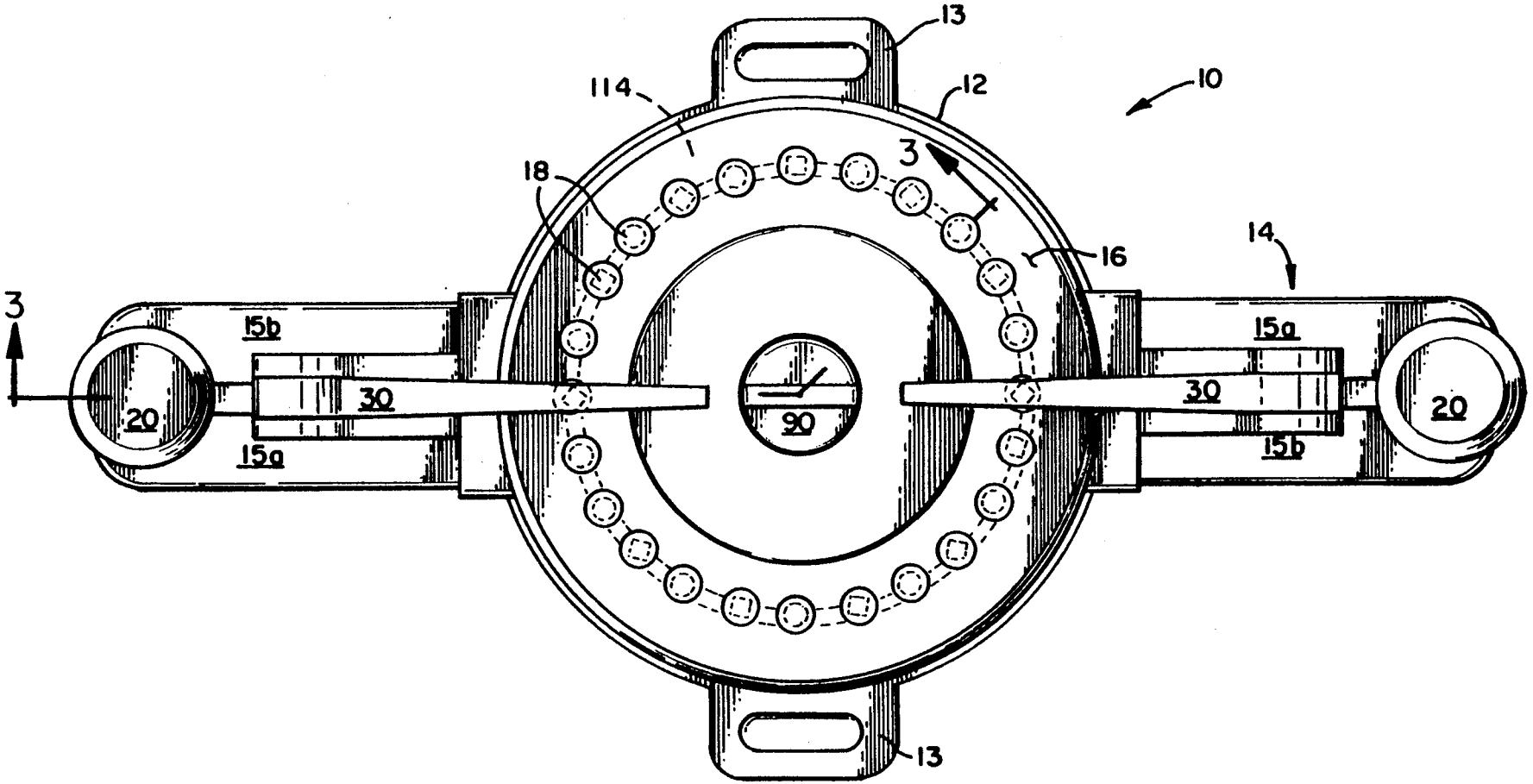
FIG. 2 is a top plan view of the game apparatus of FIG. 1.

Referring to the drawings in detail, wherein like numerals indicate like elements throughout, there is shown in FIGS. 1 and 2 two views of a preferred embodiment of a game apparatus in accordance with the present invention, which is generally designated by element numeral 10. FIGS. 3–11 show various views of the components of the game apparatus 10.

Referring now to FIGS. 1 and 2, the preferred game apparatus 10 of the present invention includes a base 12 having a pair of identical, mechanically articulated hammer devices 14 mounted to the base 12. The game apparatus 10 further includes a motor-driven revolving platform 16 which is located above the base 12. A plurality of pegs 18 protrude from the revolving platform 16 and are positioned to be hammered down by either hammer device 14 into the base 12 as each peg 18 passes by each device 14.

It is preferred that the elements and their components of the game apparatus 10, with the exception of any screws, springs or gear shafts (which are preferably constructed of a metallic material, such as steel), be constructed of a polymeric material. Specifically, it is preferred that the polymeric materials be high-impact polystyrene (HIPS), acrylonitrile-butadiene-styrene (ABS) resin and/or acetal resin. These polymeric materials provide the game apparatus 10 with a tough, rigid thermoplastic exterior and rigid, durable and lightweight components. However, it is understood by those skilled in the art that the above-mentioned elements and components could be constructed of other polymeric materials or materials having like qualities, such as, for example, polyvinylchloride or polycarbonate, without departing from the spirit and scope of the invention.

Preferably, the above-mentioned elements and components of polymeric material of the game apparatus 10 are formed by standard molding processes as understood by those skilled in the art. However, it is also understood by those skilled in the art that other methods and processes could be used to construct the elements of the game apparatus 10, such as machining.

Figure 3:
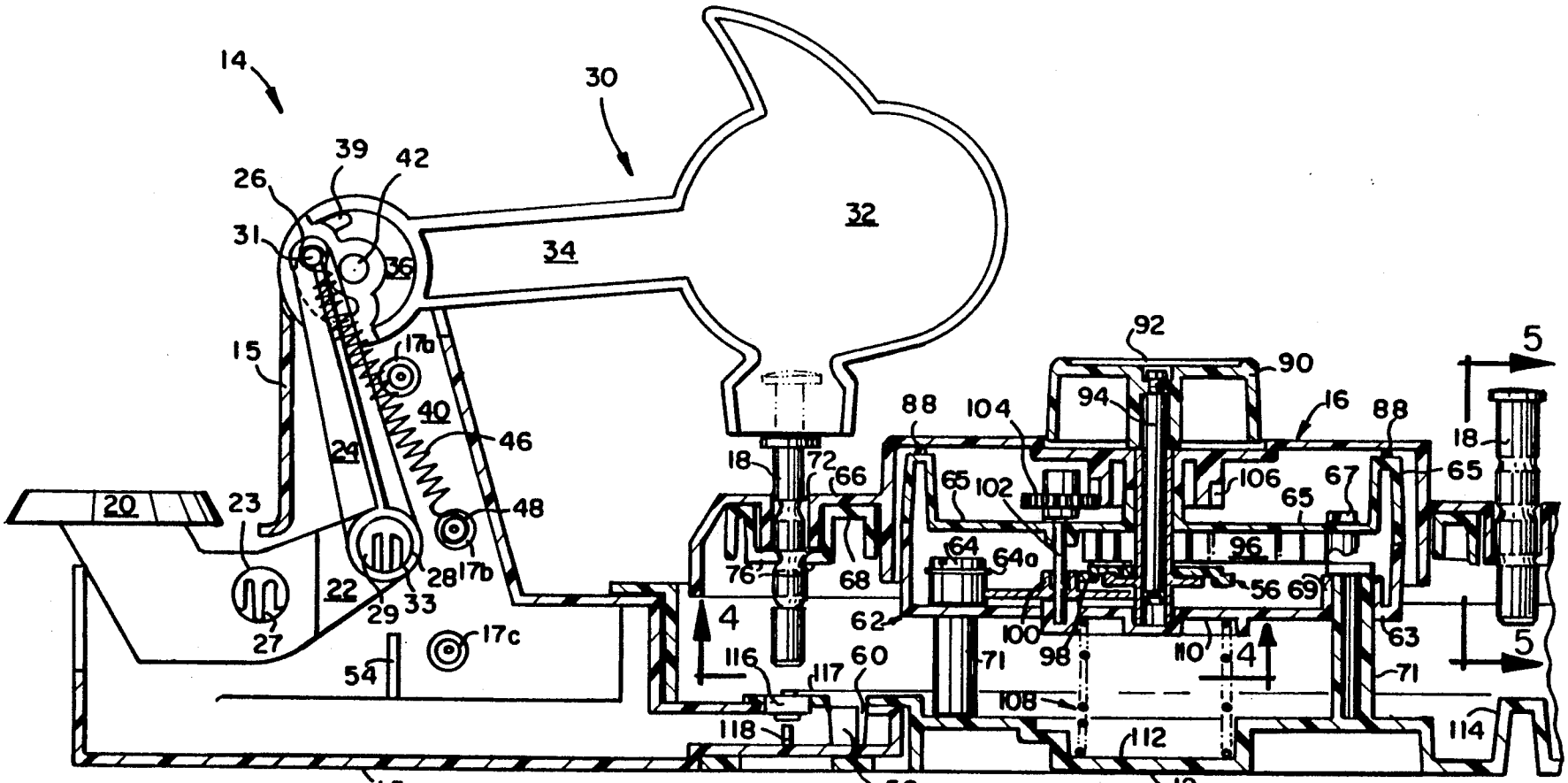
FIG. 3 is a cross-sectional view of the game apparatus taken along line 3—3 of FIG. 2.

Referring now to FIGS. 1-3, in a preferred embodiment of the present invention, each of a pair of identical, mechanically articulated hammer devices 14 of the game apparatus 10 includes a housing 15 having a right half 15*a* and a left half 15*b*. The two halves 15*a*, 15*b* attach through three mating means 17, three of which are molded into a pedestal portion 40 of the housing halves 15*a*, 15*b*. The three mating means are located in upper 17*a*, middle 17*b* and lower 17*c* areas of the pedestal portion 40. The housing 15 supports and contains various elements comprising actuator means for actuation of a hammer 30. An actuator pad 20 having a lever arm 22 with a circular aperture 23 therethrough is pivotally connected to a hinge pin 27 formed from the housing right half 15*a* and left half 15*b*. An actuator arm 24 having an upper end 26 with a circular post 31 outwardly protruding from a central portion and a lower end 28 with an aperture 33 is pivotally connected to the lever arm 22 of actuator pad 20 by a hinge pin 29 through the aperture 33 of the lower end 28 of the actuator arm 24. The hammer 30 has a head portion 32, a shank portion 34 and a base portion 36. The base portion 36 is generally circular in shape and has a circular aperture 38 through its center and a kidney-shaped slot 39 adjacent to a portion of its perimeter. Only part of the slot 39 is seen in FIG. 3. The hammer 30 is pivotally mounted through the aperture 38 to the pedestal portion 40 of the housing 15 through a hinge pin 42. The outwardly protruding circular post 31 engages the kidney-shaped slot 39 of the base portion 36. A spring hook (not shown) is located on a face of the base portion 36 which is opposite that of the kidney-shaped slot 39. The spring hook receives one end of a return spring 46. The middle mating means 17*b* forms another spring hook receiving a remaining opposing end of the spring 46.

The housing 15 includes a reset stop 54 which extends generally horizontally from a vertical wall of each of the housing halves 15*a*, 15*b*. The reset stop 54 is located directly below the point where the actuator arm 24 is pivotally connected to the lever arm 22.

The hammer device 14 is slidably mounted to the base 12 by a pair of resiliently outwardly biased locking tabs 58 which engage a pair of slots 60 in the base 12. Posteriorly adjacent to the locking tabs 58 is an opening 116 ringed by an obstruction 117. Located at the bottom of the opening 116 is a reset rib 118. If two hammer devices 14 are employed, it is preferred that they be located 180° apart from each other on the base 12. However, it is understood by those skilled in the art that other means of connecting the hammer devices 14 to the base 12 and other positioning schemes could be employed without departing from the spirit and scope of the invention.

Preferably, the base 12 is generally circular, providing stability to the game apparatus 10, and includes one or more handles 13. The base 12 further includes an upper face 112 and an annular ring 114 molded therein.

Now referring to FIG. 3, the revolving platform 16 is supported above the base 12 by a gearbox 62, which is axially slidably mounted to the base 12 by a plurality of sleeves 69 molded onto a gearbox base 63 which are received on an equal plurality of pylons 71 molded onto the base 12. The qearbox 62 will be described in more detail hereinafter.

Figure 4:
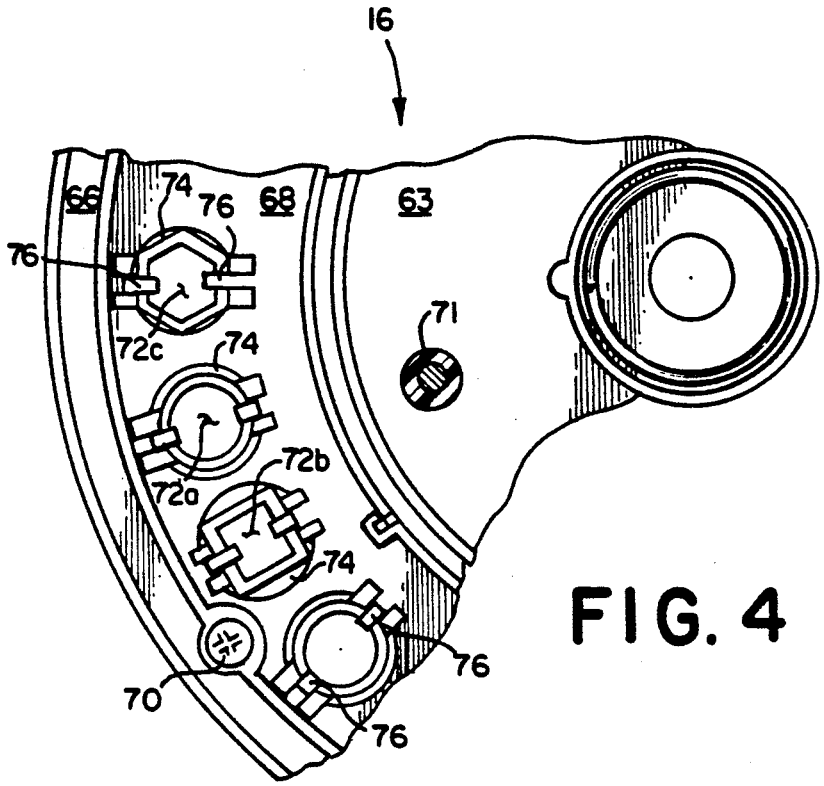
FIG. 4 is a partial cross-sectional view of the game apparatus taken along line 4—4 of FIG. 3.
Figure 5:
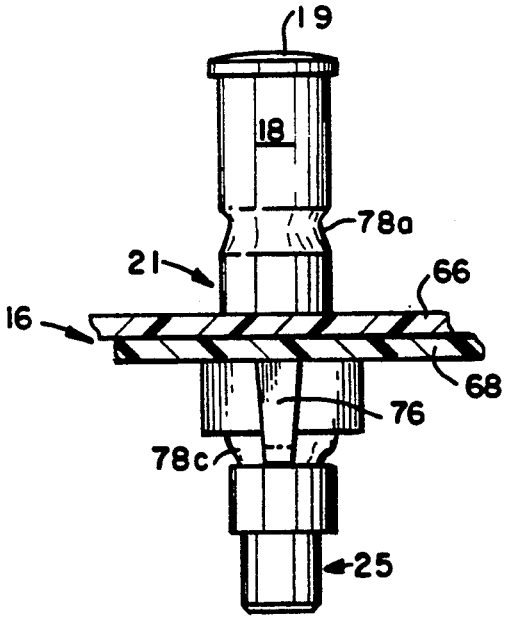
FIG. 5 is a cross-sectional view of a peg of the game apparatus taken along line 5—5 of FIG. 3.
Figure 6:
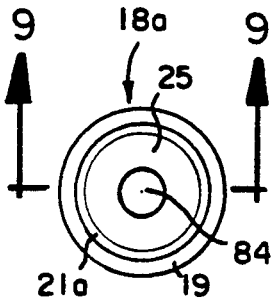
FIGS. 6–8 are bottom plan views of the pegs of the game apparatus.
Figure 7:
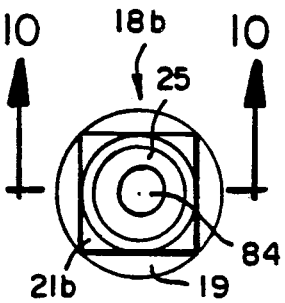
Figure 8:
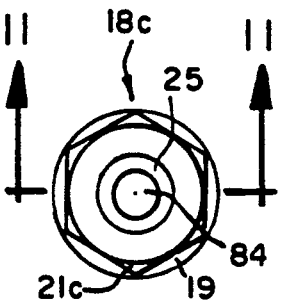

Now also referring to FIGS. 4 and 5, the revolving platform 16 includes an upper ring 66 and a lower ring 68 connected together by screws 70. The upper ring 66 has a plurality of annularly spaced apertures 72 therethrough having a circular 72*a*, square 72*b* or hexagonal 72*c* shape. In the presently preferred embodiment, there are twenty-four apertures. Two hexagonal apertures 72*c* are located 180° apart from one another and the remaining apertures consist of eleven circular apertures 72*a* alternating with eleven square apertures 72*b*. The lower ring 68 includes a plurality of annularly spaced generally circular apertures 74 therethrough, which are aligned with the apertures 72 of the upper ring 66. The lower ring 68 further includes two detents 76 located 180° apart from each other at each of the generally circular apertures 74.

Figure 9:
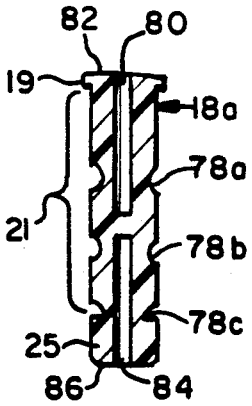
FIGS. 9–11 are cross-sectional views of the pegs of FIGS. 6–8 taken along lines 9—9, 10—10 and 11—11 of FIGS. 6, 7 and 8, respectively.
Figure 10:
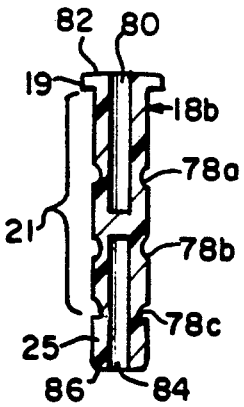
Figure 11:
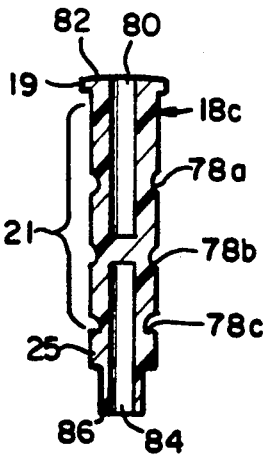

The pegs 18 are shown in detail in FIGS. 5-11 and have a head portion 19, a shank portion 21 and a tip portion 25. In the presently preferred embodiment, the pegs 18 are of three sets wherein the shank 21 of each peg is either circular 21*a*, square 21*b* or hexagonal 21*c* in shape, while the head portion 19 is round. As best seen in FIGS. 9, 10 and 11, the circular 18*a* and square 18*b* pegs are of the same length but have different diameters and cross sections in the shanks. The tip portion 25 of the hexagonal pegs 18*c* is longer than that portion of the circular 18*a* and square 18*b* pegs. Also, the hexagonal pegs 18*c* are of a third different diameter preferably greater than the diameters of pegs 18*a* and 18*b*. The pegs 18 contain an upper groove 78*a*, a middle groove 78*b* and a lower groove 78*c* which circumscribe each of the pegs. The pegs 18 further contain a top, generally circular central void 80 originating at a top 82 of the pegs and extending partially through the pegs. Similarly, a bottom, generally circular central void 84 originating at a bottom 86 of the pegs 18 extends partially through the pegs.

The circular 18*a*, square 18*b* and hexagonal 18*c* pegs are inserted through the correspondingly shaped apertures 72*a*, 72*b*, 72*c* of the upper ring 66 of the revolving platform 16. All of the pegs 18 are further inserted through the generally circular apertures 74 of the lower ring 68 of the revolving platform 16 such that the detents 76 engage the lower groove 78*c* of each of the pegs 18.

Now referring again to FIGS. 3 and 4, the gearbox 62 has a base 63 attached to a cover 65 by screws 67. The gearbox 62 is generally circular in shape and houses a spring-wound motor 56 (described in greater detail below) which unwinds in a fixed period of time. The gearbox 62 supports the revolving platform 16 on a raised surface 88. The spring-wound motor 56 is of a convention design. Preferably, the components of the spring-wound motor 56 are arranged in the following manner. Centrally located above the gearbox 62 is a circular wind-up knob 90 attached by a screw 92 to a shaft 94. A spring 96 of motor 56 is engaged with the shaft 94. Located below the attachment point of the spring 96, a 55-tooth gear 98 is mounted on the shaft 94. The 55-tooth gear 98 engages a 12-tooth gear 100 which is attached to a bottom portion of a shaft 102. A 24-tooth gear 104 is mounted on an upper portion of the shaft 102 above the gearbox cover 65. The 24-tooth gear 104 engages a ring gear 106 molded into the revolving platform 16.

Centrally located beneath the base 63 of the gearbox 62 in base 12 of the game is a biasing means, preferably in the form of a reset spring 108. The spring 108 is also thus located in the base 12 between the base 12 and platform 16. Specifically, the spring 108 is biased at an upper end against a lower face 110 of the gearbox base 63 which, in turn, supports platform 16 and biased at a lower end against an upper face 112 of the base 12. The reset spring 108 normally biases the platform 16 toward a raised or elevated position with respect to the base 12. Screws 64 and washers 64*a*, which are mounted on pylons 71, retain the gearbox 62 on the pylons 71.

In use, wind-up knob 90 is turned by a player to wind the spring 96 of the spring-wound motor 56. After the wind-up knob 90 is released, the spring 96 causes the shaft 94 to rotate which in turn rotates the 55-tooth gear 98. The teeth of the 55-tooth gear 98 mesh with the teeth of the adjacently located 12-tooth gear 100 which causes rotation of the shaft 102 which in turn rotates the 24-tooth gear 104. The teeth of the 24-tooth gear 104 engage the teeth of the ring gear 106 which causes the platform 16 to revolve about the base 12.

One or more players position one of their hands on each of the actuator pads 20. Each of the hammer devices 14 is preferably color coded to match a separate one of the first and second sets of pegs 18*a* and 18*b*. After the players decide which of the square or round peg sets 18*a*, 18*b* are to be theirs for the duration of the game, they attempt to hammer down each member of the set as those pegs revolve past their respective hammer device 14. The hammering action is actuated by manually depressing the actuator pad 20. When the actuator pad 20 is depressed, the attached lever arm 22 pivots upwardly through the aperture 23 on the hinge pin 27. The upward pivot motion of the lever arm 22 which is connected to the lower end 28 of the actuator arm 24 raises the actuator arm. The upward motion of the actuator arm 24 results in engagement of the outwardly protruding circular post 31 with an upper extremity of the kidney-shaped aperture 39 of the base portion 36 of the hammer 30 producing a downward pivoting of the head 32 of hammer 30 through rotation about the base pedestal hinge pin 42. When the actuator pad 20 is struck with sufficient force, inertia causes the hammer 30 to further continue its downward motion resulting in contact of the hammer head 32 with the head 19 of the peg 18 driving the peg into the base 12 as indicated in FIG. 3. Still greater force or a second strike is required to drive the head 32 sufficiently to contact the lower side of the kidney-shaped slot 29 and to fully drive the peg(s) 18 into the platform 16. When the downward motion of the hammer 30 is complete, the upper extremity of the return spring 46 partially retracts causing the base portion 36 to rotate upwardly. Manual release of the actuator pad 20 results in the hammer 30 returning to a fully raised position away from the revolving platform 16 and actuator pad 20 returning to an upright position by a full retraction of the return spring 46. In the upright position, the lever arm 22 of the actuator pad 20 resets against the reset stop 54. If desired, the player(s) can hold onto one of the handles 13 to further stabilize the game apparatus 10.

If successfully hammered down, a player's respective pegs will then be held by engagement of the detents 76 with the middle or top peg grooves 78*a*, *b*. After a player has hammered all of his or her respective pegs 18 of his or her set down into the base 12, that player then attempts to hammer one of the hexagonal-shaped pegs 18*c* into the base 12. When the hexagonal peg 18*c* is hammered down, the peg tip 25 enters the opening 116, and as a result of the rotation of the platform 16, encounters the obstruction 117, which is basically a wall of the opening 116, that stops the platform 16 from rotating.

The pegs 18 are reset into an upright starting position by manually depressing the wind-up knob 90 towards the base 12. This action compresses the reset spring 108 and moves the entire revolving platform 16 and any still elevated pegs 18 axially toward the base 12. The longer pegs 18*c*, which are in a hammered-down position and are aligned with the hammer device(s) 14, engage the reset rib 118 and are forced upwardly through the apertures 72 and 74 in the lower ring 68 and upper ring 66 to the upright position where the detents 76 are engaged in the bottom peg grooves 78*c*. The hammered-down pegs 18 which are located elsewhere are reset in a similar manner by the annular ring 114 molded onto the base 12. The game apparatus is then ready for another round of play.

It is appreciated by the ordinarily skilled artisan that the presently claimed invention may include other components which are equivalent to those discussed specifically above. For example, the present invention includes biasing means for the hammer device and for the platform. If desired, biasing equivalents such as other types of springs or spring linkages, compressible foams or other elastomeric materials can be used. Further, if desired, an electric motor may be provided to rotate the platform. It is also understood by those skilled in the art that only one or more than two hammer devices may be employed in the present invention. Also, different peg configurations and/or differing numbers and sets of pegs may be employed in the invention.

In view of the foregoing description, it can be seen that the present invention is directed to a game apparatus 10 which is amusing and entertaining and safe for children to play. It is appreciated by those skilled in the art that changes could be made to the embodiment described above without departing from the broad inventive concepts thereof. It is understood, therefore, that this invention is not limited to the particular embodiment disclosed, but is intended to cover all modifications which are within the scope and spirit of the invention as defined by the appended claims.

We claim:

1. A game apparatus comprising:

a base;

at least one mechanically articulated hammer device coupled with the base;

a platform mounted to revolve on the base; and a plurality of pegs protruding through the platform and positioned to be hammered into the platform by the hammer device.

2. The apparatus of claim 1 wherein the mechanically articulated hammer device comprises a pivotally supported hammer member and biasing means for biasing the hammer to an initial position away from the platform.

3. The game apparatus of claim 2 wherein the mechanically articulated hammer device further comprises actuator means coupled with the hammer member for pivoting the hammer from the initial position toward the platform.

4. The game apparatus of claim 1 further comprising a spring-wound revolving the platform.

5. The game apparatus of claim 1 wherein the plurality of pegs are of at least two different colors.

6. The game apparatus of claim 5 wherein a first set of the protruding pegs is of one color, wherein a second equal numbered set of the pegs is of a second color and wherein a third set of at least one peg is of a third color.

7. The game apparatus of claim 6 wherein each set of colored pegs is of a different diameter.

8. The game apparatus of claim 6 wherein each of the pegs has a shank, the shank of each set of colored pegs being of a different shape.

9. The game apparatus of claim 6 wherein the pegs of the third set are longer than the pegs of the first and second sets.

10. The game apparatus of claim 6 further comprising a stationary obstruction located on the base for contact by at least one peg of the third set when a third set peg is hammered sufficiently into the platform.

11. The game apparatus of claim 1 further comprising means supporting the platform for axial movement with respect to the base to reposition the pegs hammered down into the platform.

12. The game apparatus of claim 11 wherein the means supporting the platform comprise biasing means located between the platform and the base, the biasing means normally exerting a force for biasing the platform toward a raised or elevated position with respect to the base.

13. A game apparatus comprising:

a base having one or more mechanically articulated hammer devices coupled therewith; and a motor-driven revolving platform located above the base having a plurality of protruding pegs positioned to be hammered down into the platform by any of the one or more hammer devices.

14. The game apparatus of claim 13 wherein the mechanically articulated hammer devices are pivotally supported and returned by spring action.

15. The game apparatus of claim 14 wherein the mechanically articulated hammer devices are actuatable by hand.

16. The game apparatus of claim 13 wherein the motor-driven platform is powered by a spring-wound motor.

17. The game apparatus of claim 13 wherein the plurality of protruding pegs are of two or more colors.

18. The game apparatus of claim 17 wherein eleven of the protruding pegs are a set of one color, eleven are a set of another color and two are a set of a third color.

19. The game apparatus of claim 18 wherein each set of colored pegs is of a different diameter.

20. The game apparatus of claim 18 wherein the two pegs of a third color are longer than the remaining pegs.

21. The game apparatus of claim 20 further comprising an obstruction molded onto the base which can engage the longer peg of a third color when said peg is hammered all the way down.

22. The game apparatus of claim 13 wherein the revolving platform is moveable vertically with respect to the base between upper and lower positions.

23. The game apparatus of claim 22 further comprising biasing means extending between the platform and the base, the biasing means normally exerting a force to bias the platform toward a raised or elevated position with respect to the base.

* * * * *